US006133538A

United States Patent [19]

Hsu

[11] Patent Number: 6,133,538

[45] Date of Patent: Oct. 17, 2000

[54] KEYSWITCH WITH RUBBER DOME DISPOSED WITHIN HOUSING PROVIDED BY THE PLUNGER

[75] Inventor: Chien-Shih Hsu, Taipei, Taiwan

[73] Assignee: Acer Peripherals Inc., Taiwan

[21] Appl. No.: 09/378,690

[22] Filed: Aug. 20, 1999

[30] Foreign Application Priority Data

Feb. 2, 1999 [TW] Taiwan ..... 88201675

[51] Int. Cl.[7] ..... H01H 13/70

[52] U.S. Cl. ..... 200/344; 200/341

[58] Field of Search ..... 200/341–344, 200/512–517, 491.1, 491.2, 5 A

[56] References Cited

U.S. PATENT DOCUMENTS 5,512,719 4/1996 Okada et al. ..... 200/344

*Primary Examiner*—Michael L. Gellner
*Assistant Examiner*—Nhung Nguyen
*Attorney, Agent, or Firm*—Majestic, Parsons, Siebert & Hsue P.C.

[57] ABSTRACT

A push button switch is provided to include a key cap, a baseplate, a switch element, an internal arm element, an external arm element and an elastic element. The switch element is disposed on the baseplate and made selectively electrically conductive in response to up-and-down motion of the key cap. The internal arm element is movably connected to the baseplate and has a receiving space. The elastic member is disposed within the receiving space and moves responsive to movement of the key cap and selectively actuates the switch element. The improvement of the push button switch is characterized in that the internal arm element, which is movably connected to the baseplate, has a receiving space for accommodating the elastic member. The elastic member moves responsive to movement of the key cap and selectively actuates the switch element.

11 Claims, 3 Drawing Sheets

KEYSWITCH WITH RUBBER DOME DISPOSED WITHIN HOUSING PROVIDED BY THE PLUNGER

TECHNICAL FIELD OF THE INVENTION

The invention relates to a push button switch, and in particular, to a push button switch which has a rubber dome disposed within housing provided by the plunger.

BACKGROUND OF THE INVENTION

The push button switch with scissors-type plunger is broadly used in notebook type computer.

U.S. Pat. Nos. 5,278,371, 5,746,308, 5,512,719, 5,457,297, 4,433,225, 4,580,022, 4,902,862, 5,280,147, 5,329,084, 5,382,762, 5,399,822, 5,463,195, 5,466,901, 5,504,283, 5,519,569, 5,512,719, 5,278,372 and 5,278,374 respectively disclose key switch of scissors-type plunger.

SUMMARY OF THE INVENTION

Main object of the invention is to provide an alternative push button switch having scissors-type plunger.

The improvement is characterized in that the internal arm element, which is movably connected to the baseplate, has a receiving space for accommodating the elastically deformable actuation device. The elastically deformable actuation device moves responsive to movement of the key cap and selectively actuates the switch element.

The push button switch provided includes a key cap, a baseplate, a switch element, an internal arm element and an elastic element.

The switch element is disposed on the baseplate and made selectively electrically conductive in response to up-and-down motion of the key cap.

The internal arm element is movably connected to the baseplate. The internal arm element has a receiving space.

The elastically deformable actuation device is disposed within the receiving space and moves responsive to movement of the key cap and selectively actuates the switch element.

Other objects and advantages of the invention will be apparent from the following detailed descriptions of the invention along with the appended drawings.

DETAILED DESCRIPTION OF THE INVENTION

Figure 1:
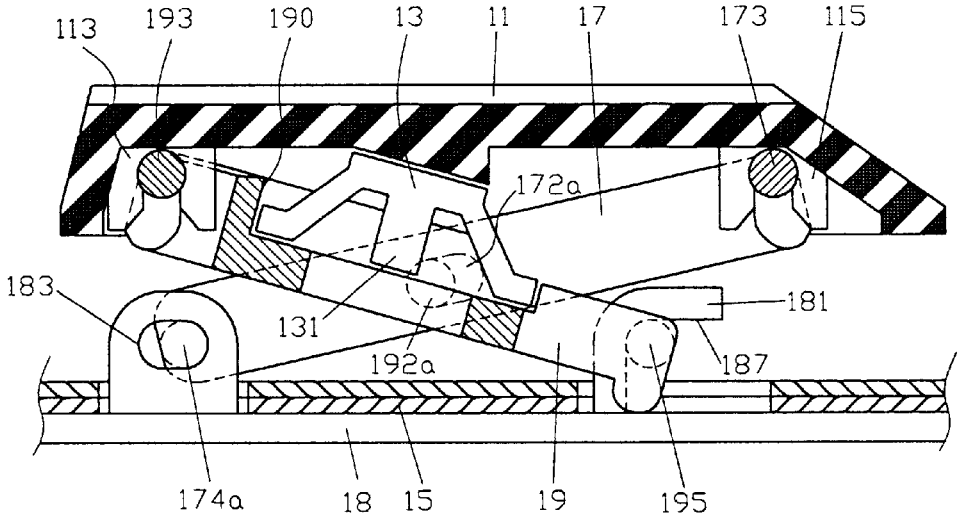
FIG. 1 shows a sectional view of the push button switch of the first embodiment.

As shown in FIG. 1, a push button switch of the invention includes a key cap 11, an internal arm element 19, an external arm element 17, an elastically deformable actuation device 13, a membrane switch 15 and a baseplate 18. The internal arm element 19 and external arm element 17 are rotatably connected together to form the scissors-like plunger of the push button switch. The baseplate 18 has a main flat surface and has a pair of receiving slots 183 and a bearing portion 181 formed thereon. The elastically deformable actuation device 13 has a bottom which is provided with a protrusion 131.

The key cap 11 has a bottom surface, and a first pair of spaced-apart bearing portions 113 and a second pair spaced-apart bearing portions 115 are formed on the bottom surface as shown in FIG. 1.

Figure 4:
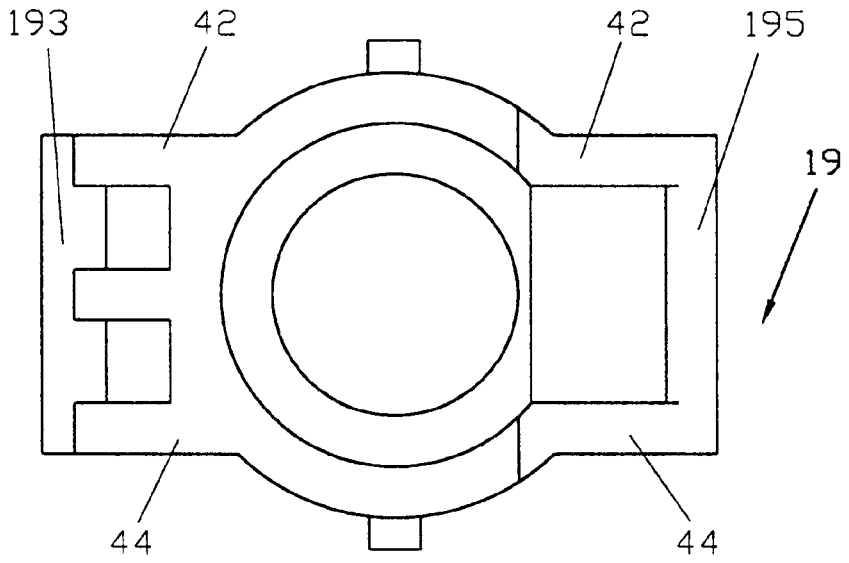
FIG. 4 shows the top view of the internal arm element of the push button switch of the first embodiment.

As shown, the internal arm element 19 has a first shaft 193 provided at a first end thereof which is rotatably connected to the first pair of spaced-apart bearing portions 113 of the key cap 11. The internal arm element 19 further includes a second shaft 195 provided at a second end thereof which is slidably rotatably received in the bearing portion 181 of the baseplate 18. During operation of the switch, the upper surface of the second shaft 195 slidably rotatably contacts with the inner surface of the bearing portion 181. The internal arm element 19 includes a first side frame 42 and a second side frame 44 provided to connect the first shaft 193 and the second shaft 195 at the first end and the second end thereof respectively as shown in FIG. 4. As recited hereinafter, the internal arm element 19 has a receiving space 190 for accommodating the elastically deformable actuation device 13.

Figure 5:
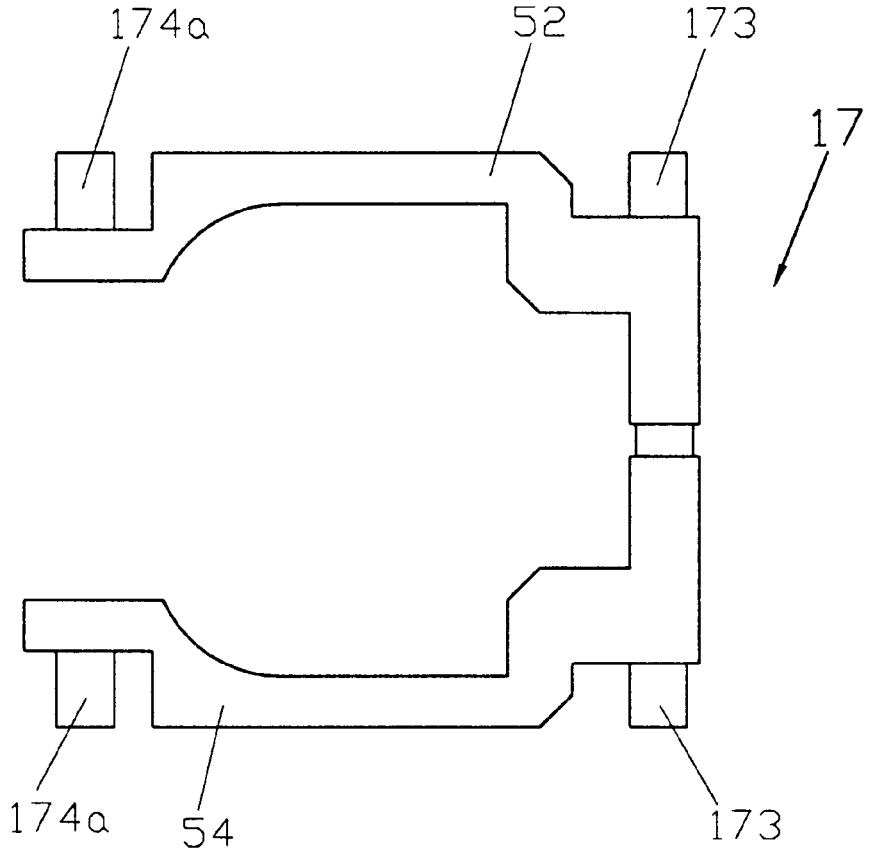
FIG. 5 shows the top view of the external arm element of the push button switch of the first embodiment.

As shown in FIG. 1, the external arm element 17 has a shaft 173 provided at an end thereof which is rotatably connected to the second pair of spaced-apart bearing portions 115 of the key cap 11. The external arm element 17 includes a first side frame 52 and a second side frame 54 both connected to the shaft 173 at the first end hereof respectively. A pin 174*a* is provided at a second end, which is opposed to he first end, of each of the first and second side frames and is slidably rotatably received in one corresponding slot of the pair of receiving slots 183 formed on the baseplate 18, as shown in FIG. 1 and FIG. 5.

Since the slots 172*a* are curved slots, the internal arm member 19 and the external arm member 17 are slidably and rotatably connected together via connection member 192*a* and corresponding slot 172*a* to form the scissors-type plunger as the conventional way.

In one embodiment, the elastically deformable actuation device 13 is disposed under the key cap 11, but does not situate onto the membrane switch 15. As shown, the elastically deformable actuation device 13 is received in the receiving space provided by the internal arm element and deforms according to up-and-down movement of the key cap 11.

The membrane switch 15 is used in a conventional manner for on-off control of a piece of electric equipment (not shown), in response to the pressing action of the protrusion 131 of the actuation device 13. In other words, the downward action of the key cap 11 causes the scissors-type action of the internal arm element 19 and the external arm element 17. At the same time, the movement of key cap 11 causes downward movement and deformation of the elastically deformable actuation device 13. This brings about the pressing action of the protrusion 131 to the corresponding membrane switch 15. As the external force is released, resuming force of the elastically deformable actuation device 13 causes the push button switch to the initial condition.

Figure 2:
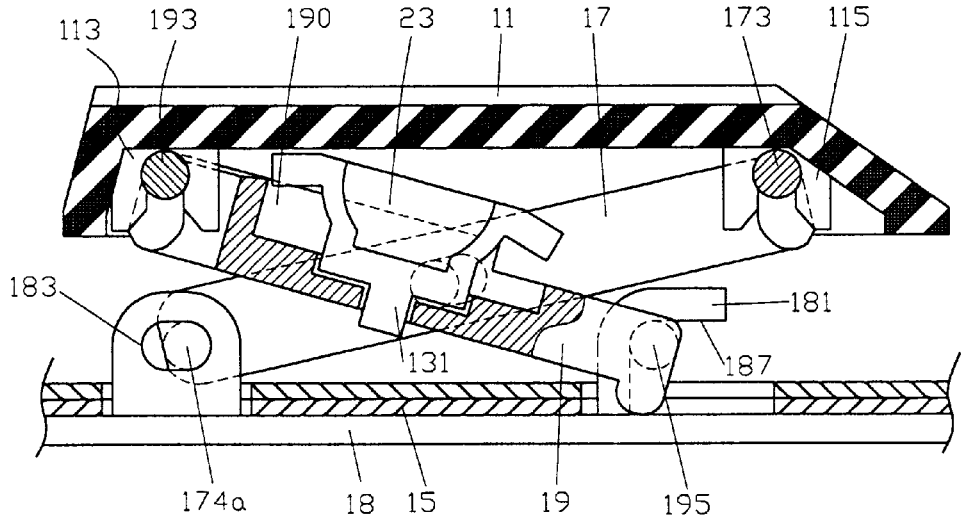
FIG. 2 shows a sectional view of the push button switch of the second embodiment.

FIG. 2 shows the second embodiment of the invention. For simplicity purpose, the elements denoted by like numeral in FIG. 1 and 2, have same or equivalent structure and perform the same function. For simplicity purpose, those elements are not recited in details while describing the second embodiment.

The push button switch of the second embodiment includes a key cap 11, an internal arm element 19, an external arm element 17, an elastically deformable actuation device 23, a membrane switch 15 and a baseplate 18. The connection relationship of the elements shown in FIG. 2 and also shown in FIG. 1 can be found in the recitations regarding FIG. 1. However, distinct from the first embodiment, the elastically deformable actuation device 23 is received in the receiving space of the internal arm 19 element by an opposite manner to the elastically deformable actuation device 13 in the first embodiment. In addition, a protrusion 131 is provided in the elastically deformable actuation device 23. The downward action of the key cap 11 causes the scissors-type action of the internal arm element 19 and the external arm element 17. At the same time, the movement of key cap 11 causes downward movement and deformation of the elastically deformable actuation device 23. This brings about the pressing action of the protrusion 131 to the corresponding membrane switch 15. As the external force is released, resuming force of the elastically deformable actuation device 23 causes the push button switch to the initial condition.

Figure 3:
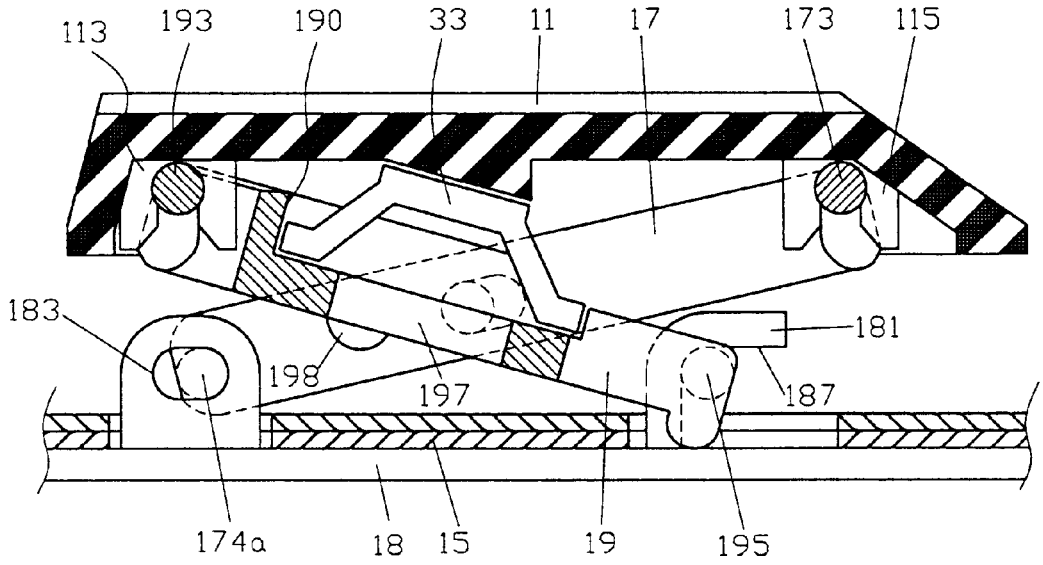
FIG. 3 shows a sectional view of the push button switch of the third embodiment.

FIG. 3 shows the third embodiment of the invention. For simplicity purpose, the elements denoted by like numeral in FIG. 1 and 3, have same or equivalent structure and perform the same function. For simplicity purpose, those elements are not recited in details while describing the third embodiment.

The push button switch of the third embodiment includes a key cap 11, an internal arm element 19, an external arm element 17, an elastically deformable actuation device 33, a membrane switch 15 and a baseplate 18. The connection relationship of the elements shown in FIG. 3 and also shown in FIG. 1 can be found in the recitations regarding FIG. 1. However, distinct from the first embodiment, the elastically deformable actuation device 33 does not include a protrusion. Therefore, the elastically deformable actuation device 33 is capable of deforming while without function of switch actuation. Nevertheless, a cantilever member 197, which functions as an actuator to selectively actuate the switch element and has a projection 198 on its bottom, is provided in the internal arm element. The downward action of the key cap 11 causes the scissors-type action of the internal arm element 19 and the external arm element 17. At the same time, the movement of key cap 11 causes downward movement and deformation of the elastically deformable actuation device 33. This brings about the pressing action of the projection 198 to the corresponding membrane switch 15. As the external force is released, resuming force of the elastically deformable actuation device 33 causes the push button switch to the initial condition.

What is claimed is:

1. A push button switch comprising:

a key cap;

a baseplate;

a switch element disposed on the baseplate and made selectively electrically conductive in response to up-and-down motion of the key cap;

an internal arm element movably connected to the baseplate, the internal arm element having a receiving space; and an elastically deformable actuation device disposed within the receiving space, said elastically deformable actuation device moving responsive to movement of the key cap and selectively actuating the switch element.

2. The push button switch according to claim 1, wherein the key cap has a top surface, a bottom surface, a first pair of spaced-apart bearing portions formed on the bottom surface and a second pair of spaced-apart bearing portions formed on the bottom surface.

3. The push button switch according to claim 2, wherein a pair of receiving slots and a bearing portion are provided on the base plate has a main plate surface.

4. The push button switch according to claim 1, wherein the internal arm element has a first shaft provided at a first end thereof, the first shaft is rotatably connected to the first pair of spaced-apart bearing portions, the internal arm element further includes a second shaft provided at a second end thereof, the second shaft is slidably rotatably received in the bearing portion, the internal arm element includes a first side frame and a second side frame provided to connect the first shaft and the second shaft at the first end and the second end respectively.

5. The push button switch according to claim 2, further comprising:

an external arm element movably connected to the internal arm element to form a scissors-type plunger, the external arm element having a third shaft provided at a third end thereof, the third shaft being rotatably connected to the second pair of spaced-apart bearing portions, the external arm element including a third side frame and a fourth side frame connected to the third shaft at the third end thereof respectively, a pin being provided at a fourth end, which is opposed to the third end, of each of the third and fourth side frames and being slidably rotatably received in the pair of receiving slots.

6. The push button switch according to claim 1, wherein the elastically deformable actuation device further comprises a protrusion on a bottom thereof for selectively actuating the switch element.

7. A push button switch comprising:

a key cap;

a baseplate;

a switch element disposed on the baseplate and made selectively electrically conductive in response to up-and-down motion of the key cap;

an internal arm element movably connected to the baseplate, the internal arm element having a receiving space; and an elastically deformable actuation device disposed within the receiving space, said elastically deformable actuation device moving and deforming responsive to movement of the key cap;

wherein the internal arm element comprises a cantilever member, and further wherein a projection is provided at a bottom of the cantilever member to form an actuator to, responsive to movement of the key cap, selectively actuate the switch element.

8. The push button switch according to claim 7, wherein the key cap has a top surface, a bottom surface, a first pair of spaced-apart bearing portions formed on the bottom surface and a second pair of spaced-apart bearing portions formed on the bottom surface.

9. The push button switch according to claim 8, wherein a pair of receiving slots and a bearing portion are provided on the baseplate, the baseplate has a main plate surface.

10. The push button switch according to claim 7, wherein the internal arm element has a first shaft provided at a first end thereof, the first shaft is rotatably connected to the first pair of spaced-apart bearing portions, the internal arm element further includes a second shaft provided at a second end thereof, the second shaft is slidably rotatably received in the bearing portion, the internal arm element includes a first side frame and a second side frame provided to connect the first shaft and the second shaft at the first end and the second end respectively.

11. The push button switch according to claim 8, further comprising:

an external arm element movably connected to the internal arm element to form a scissors-type plunger, the external arm element having a third shaft provided at a third end thereof, the third shaft being rotatably connected to the second pair of spaced-apart bearing portions, the external arm element including a third side frame and a fourth side frame connected to the third shaft at the third end thereof respectively, a pin being provided at a fourth end, which is opposed to the third end, of each of the third and fourth side frames and being slidably rotatably received in the pair of receiving slots.

* * * * *